United States Patent [19]

Poudrier et al.

[11] Patent Number: 4,768,662

[45] Date of Patent: Sep. 6, 1988

[54] SELF-LOCKING HYDRAULIC PIVOT DEVICE FOR INTERCONNECTING A SUPPORT CAGE TO A BOOM

[75] Inventors: Bertrand Poudrier; Francois Thibault, both of Victoriaville; Sylvain Leduc, Arthabaska, all of Canada

[73] Assignee: Posi-Plus Technologies Inc., Quebec, Canada

[21] Appl. No.: 37,728

[22] Filed: Apr. 13, 1987

[51] Int. Cl.[4] ..... B66C 23/86

[52] U.S. Cl. ..... 212/245; 212/248

[58] Field of Search ..... 212/245, 246, 247, 248, 212/223, 229, 232; 74/422; 440/60

[56] References Cited

U.S. PATENT DOCUMENTS

| | | | |
|---|---|---|---|
| 2,796,998 | 6/1957 | Sundin | 212/248 |
| 3,032,207 | 5/1962 | McIntyre | 212/248 |
| 4,041,889 | 8/1977 | Blanchard | 440/60 |
| 4,111,316 | 9/1978 | Wappler | 212/248 |
| 4,479,400 | 10/1984 | Rieger | 74/422 |

*Primary Examiner*—Joseph F. Peters, Jr.

*Assistant Examiner*—Stephen P. Avila

*Attorney, Agent, or Firm*—Oblon, Fisher, Spivak, McClelland & Maier

[57] ABSTRACT

A hydraulic pivot device for pivotally connecting a support housing to a boom of the type secured to a vehicle. The hydraulic pivot device comprises a main housing having a gear-engaging piston which is axially displaceable in a piston cylinder provided therein. The piston has opposed piston heads and is sealingly displaced placed in the piston cylinder by fluid pressure applied at a selected one of opposed ends of the piston cylinder. The piston is also positively interlocked by the use of lock valves which are port-mounted at each end of the piston cylinder. A drive shaft having a drivable pinion gear is supported within the housing with a drivable pinion gear being in toothed engagement with a toothed section of the piston so that axial displacement of the piston wall impact axial rotation to the drive shaft. The drive shaft has a connection section exteriorly of the housing which is in engagement with a connector element which is secured to the support housing for imparting controlled displacement thereof.

10 Claims, 3 Drawing Sheets

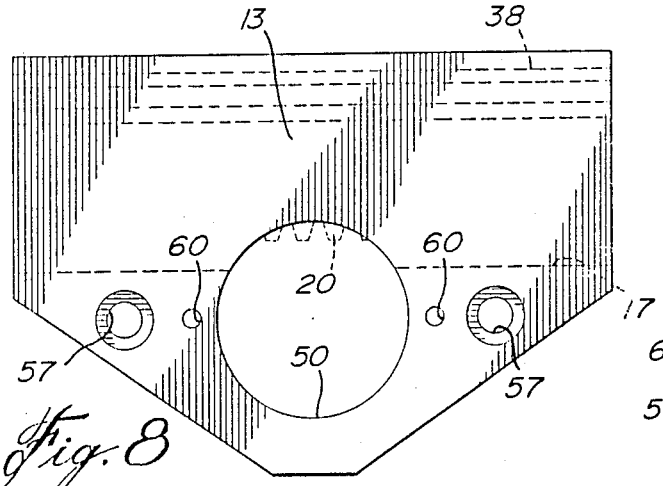
Fig. 8
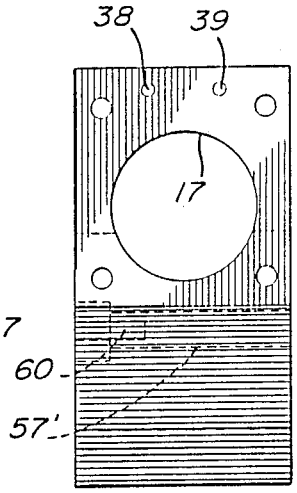
Fig. 9
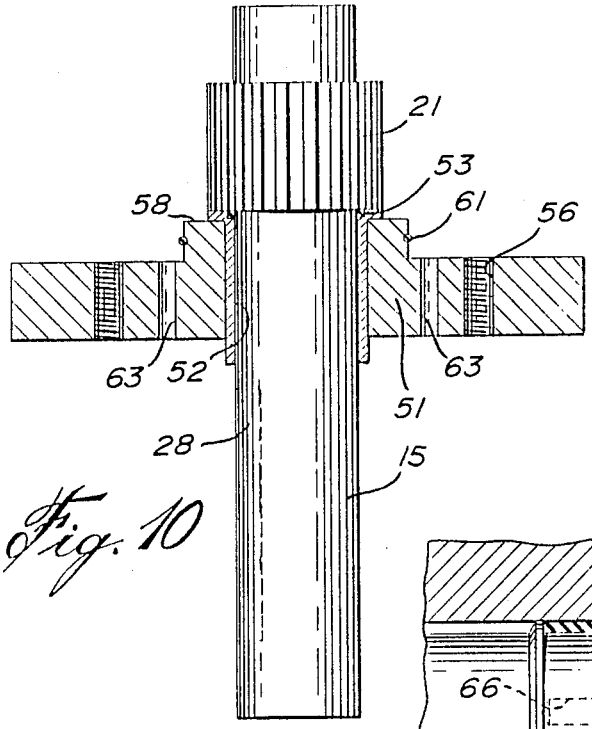
Fig. 10
Fig. 11
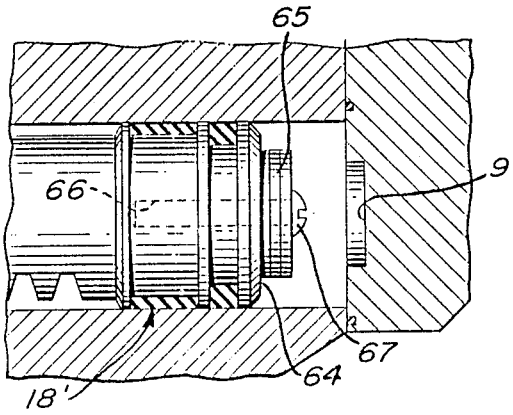

SELF-LOCKING HYDRAULIC PIVOT DEVICE FOR INTERCONNECTING A SUPPORT CAGE TO A BOOM

BACKGROUND OF INVENTION (a) Field of the Invention

The present invention relates to a hydraulic pivot device capable of imparting controlled arcuate displacement to a support housing or cage secured to a boom which is normally attached to a vehicle whereby the support housing or cage may be arcuately displaced on a pivot by applying fluid pressure to a piston controlling the axial rotation of the pivot and wherein the piston is positively interlocked to a desired position.

(b) Description of Prior Art

It is known to pivotally connect a support housing or cage to a hydraulic boom whereby the cage can be arcuately displaced on a connector element which is secured to the boom or an intermediate boom element. Such devices utilize various types of gearing arrangements which are operated by various means such as, for example, a crank arm which is manually rotated whereby the cage is caused to pivot along a horizontal plane in the right or left direction depending on the direction of rotation of the crank lever, i.e. either to the right or to the left. A disadvantage of this type of device is that it is bulky, requires frequent maintenance and repair, and are difficult to operate by the operator. Because of their construction, they are also hazardous as the crank arm protrudes from the housing and may be the cause of serious accidents, particularly when the support cage is located close to electrical transmission lines.

SUMMARY OF INVENTION

Although hydraulic devices have been employed to overcome the disadvantage of the crank arm devices, it is a feature of the present invention to provide an improved hydraulic pivot device that utilizes a rack and pinion piston arrangement which has a positive self-locking characteristic by using port-mounted pilot operated check valve.

Another feature of the present invention is to provide an improved hydraulic pivot device for pivotally connecting a support housing or cage to a boom and which is compact, efficient, requires very little maintenance, is easy to operate and which substantially overcomes all of the above mentioned disadvantages of the prior art.

According to the above features, from a broad aspect, the present invention provides a hydraulic pivot device for pivotally connecting a support housing to a boom. The hydraulic pivot device comprises a main housing having a gear-engaging piston axially displaceable in the piston cylinder provided in the housing. The piston has opposed piston heads and circumferential sealing means for sealing engagement with the piston cylinder. Conduit means is associated with the respective one of opposed ends of the piston cylinder for applying a hydraulic force against a selected one of the piston heads. A pilot operated lock valve is associated with a respective one of the conduits. Means is also provided to control the opening and closing of the lock valves to positively interlock the piston to a desired position. A drive shaft, having a drivable pinion gear, is supported in the housing for toothed engagement with a toothed section of the piston so that axial displacement of the piston will impart axial rotation to the drive shaft. The drive shaft also has a connection section exteriorly of the housing and in engagement with a connector element secured to the support housing for imparting controlled displacement thereof.

BRIEF DESCRIPTION OF DRAWINGS

A preferred embodiment of the present invention will now be described with reference to the accompanying drawings, in which:

FIG. 8 is a bottom view of the main housing;

FIG. 9 is a side view of the main housing;

FIG. 10 is an enlarged view of the drive shaft assembly; and

FIG. 11 is a fragmented end view of the piston head section of the device.

DESCRIPTION OF PREFERRED EMBODIMENTS

Figure 1:
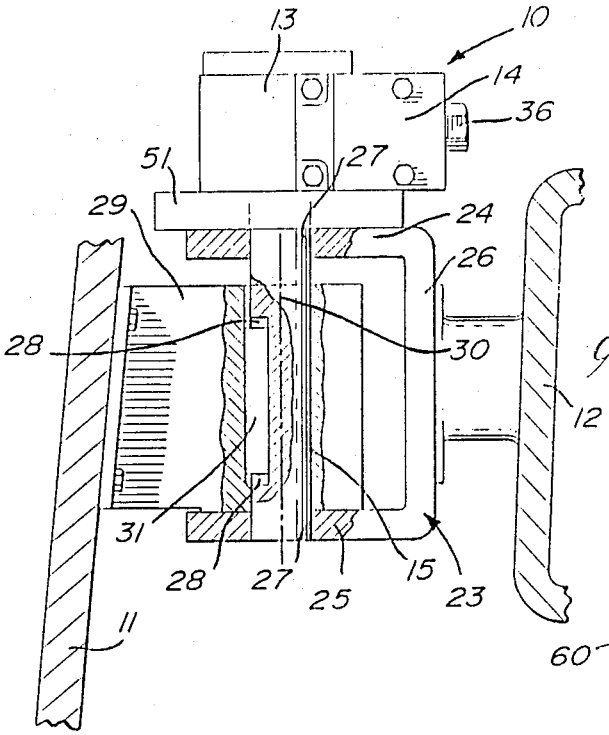
FIG. 1 is a partly fragmented side view showing the hydraulic pivot device of the present invention interconnecting a boom to a support housing or cage.
Figure 2:
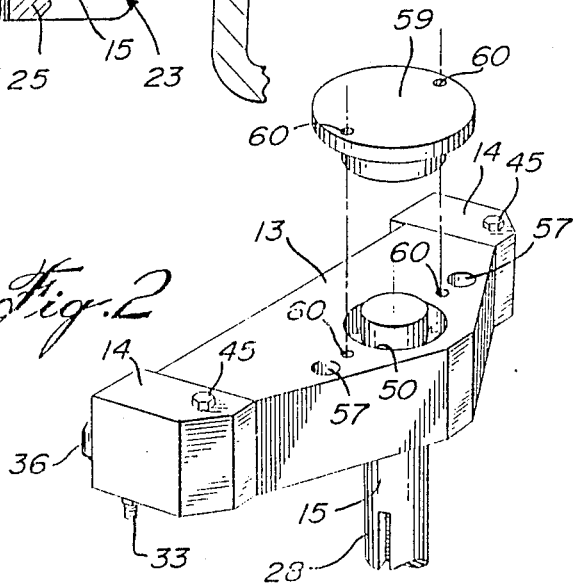
FIG. 2 is a partly exploded view of the hydraulic pivot device of the present invention.
Figure 3:
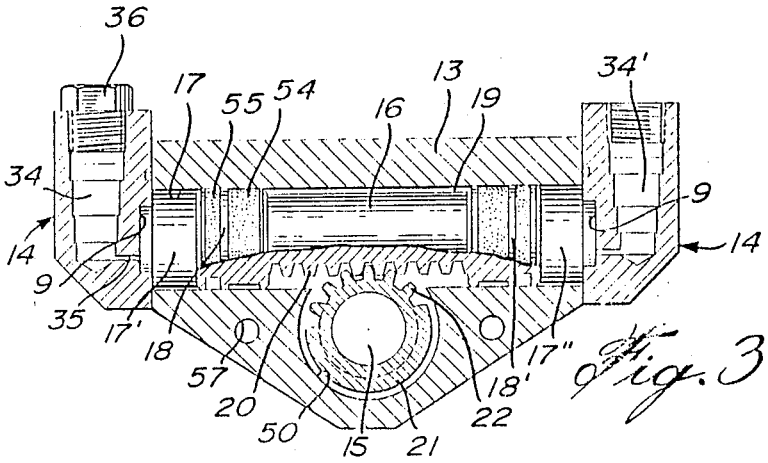
FIG. 3 is a section view through the main housing of the hydraulic pivot device.

Referring now to the drawings, and more particularly to FIGS. 1 to 3, there is shown generally at 10 the hydraulic pivot device for pivotally connecting a support housing 11, herein shown in part only, but well known to a person skilled in the art, to a boom 12, also herein shown in part, such as a boom secured to a land vehicle. The hydraulic pivot device 10 consists of a main housing 13 to which is secured at opposed ends thereof a removable lock valve housing 14 which will be described later in detail. A drive shaft 15 extends into the main housing 13 and depends thereunder.

Referring more specifically to FIG. 3, there is shown the construction of the main housing 13 and it is provided with a gear-engaging piston 16 which is axially displaceable in a piston cylinder 17. The piston 16 is provided with opposed piston heads 18 and 18' and is sealingly displaceable within the piston cylinder 17 by means of fluid pressure applied at a selected one of the ends 17' or 17'' of the piston cylinder against the piston heads 18 or 18'. A large cavity 9 is provided in the end walls of the cylinder ends 17' and 17'' to provide a large fluid pressure surface against the piston heads when resting on the end walls. Also, the cavity 9 accomodates a fastener which may be secured in the piston heads, as will be described later with reference to FIG. 11.

As herein shown, the piston 16 is provided as an elongated piston rod of circular cross-section. An intermediate portion 19 of the piston is of reduced diameter and extends between the piston heads. This intermediate portion is provided, in a portion thereof, with a series of gear teeth 20 disposed in a straight plane and constituting a toothed rack. The drive shaft 15 is provided with a pinion gear 21 secured or otherwise machined adjacent an end thereof and located within the main housing 13 with the pinion gear 21 being in toothed engagement with the toothed rack 20. As herein shown, the pinion gear 21 is provided with teeth 22 about its circumference to axially rotate the drive shaft 19 through an arc. Thus, it can be seen that, by displacing the piston 16 axially within the piston cylinder 17, the pinion gear is caused to rotate.

Referring again to FIGS. 1 and 2, it can be seen that the main housing 13 is secured to a bracket 23 by a bottom wall portion 51. The bracket 23 is secured to the boom 12 by suitable securing means. As herein shown, the bracket is of U-shape and defines opposed parallel flat walls, herein a top wall 24 and a bottom wall 25 and an interconnecting end wall 26. The section of the drive shaft 15 which extends out of the bottom wall 51 of the housing 13 also extends in opposed aligned cavities 27 provided in respective ones of the top and bottom parallel walls 24 and 25 of the bracket 23. The drive shaft 15 also has a drive spline connection section 28 disposed intermediate these parallel walls 24 and 25. A connector element 29 is pivotally retained between the opposed walls 24 and 25 connected to the spline 28 by a key 31. The drive shaft 15 is rotated on its longitudinal pivot axis 30 by the piston when displaced in its cylinder. When the drive shaft is axially rotated the connector 29 will is displaced with it on its pivot axis 30 and consequently the support housing or cage 11 is also displaced along a horizontal arc.

Figure 5:
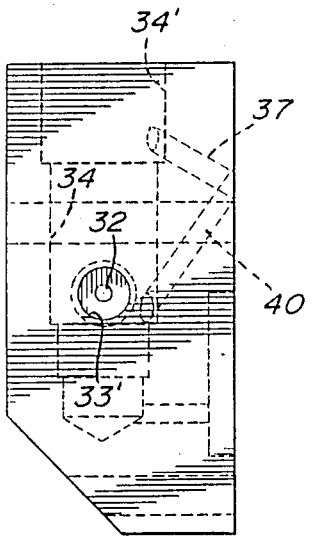
FIG. 5 is a side view of FIG. 4.
Figure 4:
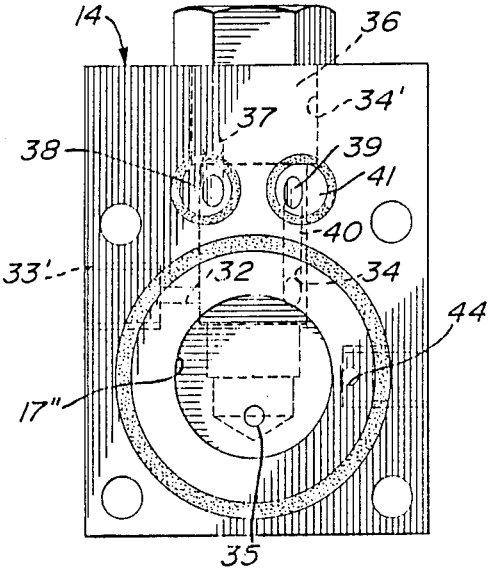
FIG. 4 is a bottom view of a removable housing including conduit means and a lock valve.
Figure 6:
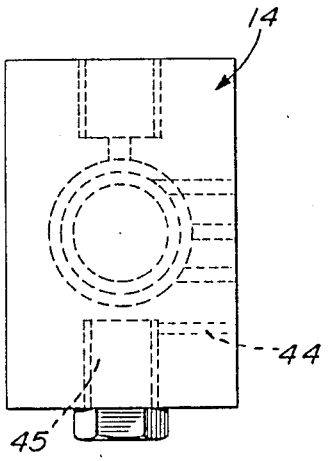
FIG. 6 is an end view of FIG. 4.
Figure 7:
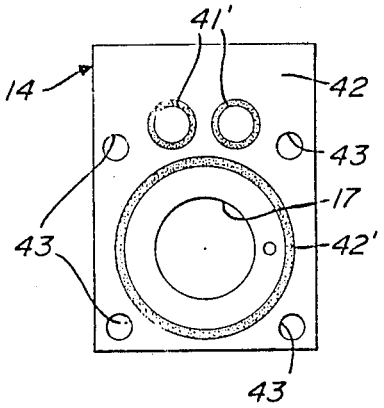
FIG. 7 is a bottom view, the same as FIG. 4 but showing the sealing arrangement.

Referring now additionally to FIGS. 5–7, there will be described the construction and operation of the hydraulic system which controls the axial rotation of the drive shaft. As previously described, a removable lock valve housing 14 is bolted to opposed ends of the main housing 13 and it is through this housing that hydraulic fluid flows in a controllable manner. These removable lock valve housings are provided with conduit means which are in communication with proposed ends of the piston cylinder 17.

As herein shown, the removable lock valve housings 14 are provided with an inlet conduit 32 having a hose fitting bore 33' to connect a hose fitting 33 thereto to apply hydraulic fluid pressure. The inlet conduit 32 communicates with a fluid chamber 34. The fluid chamber 34 has a port 35 which communicates with one of the opposed end chambers 17' and 17'' of the piston cylinder 17. A lock valve 36, well known in the art, is received in an end portion 34' of the fluid chamber 34. Also, through a first conduit 37, the lock valve 36 is in fluid communication, through an intermediate conduit 38 extending in the main housing 13, with the fluid chamber 34 in the opposite removable lock valve housing 14. A second intermediate conduit 39, within the main housing 13, also connects the first conduit 37 of the other removable lock valve housing 14 to the fluid chamber 34 of the opposed removable lock valve housing via a second conduit 40 provided in the removable lock valve housing. The purpose of the lock valve 36 received in chamber 34 is to prevent any fluid flow out of the end chamber 17' (and 17'') thus creating positive locking of the support cage 11 when not in operation. In order to allow displacement of piston 16, one lock valve 36 is piloted via pilot conduits 40, 39 and 37 by pressure applied at fluid chamber 34 of the opposite housing 14.

When the piston is displaced in a selected one of opposed directions, the fluid at one end of the piston can be vacated from the chamber 17' and 17'' to a reservoir or tank, not shown.

After the hydraulic pressure stops, the valves are all closed to positively interlock the piston 16 as the hydraulic liquid cannot flow anywhere.

As shown in FIG. 7, O-ring seals 41' are disposed in the mating face 42 of the removable housing 14 whereby to provide a seal between the end faces of the main chamber 13 and the mating face of the removable housings 14. Also, a further O-ring seal 42' is provided about the cylinder 17, also for sealing engagement. Connecting holes 43 permit the bolt connection of these housings 14 to the main housing 13.

In order to evacuate air from the hydraulic fluid conduits within the device 10, there is provided a bleeder or evacuation port 44 which is open or closed by unthreading or threading a bleed screw 45 in communication therewith.

Referring now to FIGS. 8–10, there will be described the manner in which the drive shaft is connected to the main housing 13. As herein shown, the main housing is provided with a through-bore 50 which is partly offset from the piston cylinder bore 17. The pinion gear 21 is supported on the removable bottom wall portion 51 of the housing 13 about a bushing 52. An O-ring seal 53 is retained by the bushing 52 about the shaft 15 to prevent any leakage of a lubricant used for the rack 20 and pinion gear 21. Each piston head 18 and 18' is provided with an anti-friction ring 54 and a seal ring 55 spaced apart about its periphery.

The bottom wall section 51 is secured to the top wall 24 of the U-shaped bracket 23 by means of bolts going through holes 63 and mating holes (not shown) in the bracket top wall. The holes 57 and bores 56 are for securing to wall section 51 to the housing. An O-ring seal 61 also is provided around a circular elevated ring portion 58 of the bottom wall 51 and is received within the through-bore 50. A cover 59 closes off the top opening of the through-bore 50 and is fastened thereto by means of bolts which are fastened in the aligned threaded bore 60. The pinion gear end of the drive shaft is sealingly received within the cover 59.

Referring now to FIG. 11, it can be seen that the piston's maximum stroke can be adjusted by securing spacer discs 65 in the end wall 64 of the piston heads 18' and 18. A threaded bore 66 is provided in the end wall 64 to receive a fastener 67. The head of the fastener 67 is received in the cavity 9, as previously described.

It is within the ambit of the present invention to cover any obvious modifications of the preferred embodiment described herein, provided such modifications fall within the scope of the appended claims.

We claim:

1. A self-locking hydraulic pivot device for pivotally connecting a support housing to a boom, said hydraulic pivot device comprising a main housing having a gear-engaging piston axially displaceable in a piston cylinder provided in said housing, said piston having opposed piston heads and circumferential sealing means for sealing engagement with said piston cylinder, lock valve housings secured to opposed ends of said piston cylinder, conduit means in each said lock valve housing and associated with a respective one of opposed ends of said piston cylinder for applying a hydraulic force against a selected one of said piston heads, a pilot operated lock valve connected to each said lock valve housing and associated with a respective one of said conduits, each said lock valve is a pressure sensitive operated pilot valve, each said lock valve being in fluid communication with an end chamber at a respective one of opposed ends of said cylinder through said conduit means, means to control the opening and closing of each said lock valve to positively interlock said piston at a desired position, said means being pilot conduits to connect the fluid chamber of a first one of said lock valves with the other valve and the fluid chamber of the other valve with the first valve whereby one of said lock valves is opened when fluid pressure is applied to one of said fluid chambers to cause said piston to be displaced and also to cause fluid flow from one of the said end chambers to a reservoir, a drive shaft having a drivable pinion gear supported in said housing for toothed engagement with a toothed section of said piston so that axial displacement of said piston will impart axial rotation to the drive shaft, said drive shaft having a connection section exteriorly of said housing and in engagement with a connector element secured to said support housing for imparting controlled displacement thereof.

2. A hydraulic pivot device as claimed in claim 1, wherein said main housing is secured to a bracket attached to a boom of a vehicle, a connector having a key engaged in a spline provided in said connection section of said drive shaft so that axial rotation of said drive shaft will cause said connector to be displaced on the central longitudinal axis of said drive shaft.

3. A hydraulic pivot device as claimed in claim 2, wherein said bracket is a U-shaped bracket having opposed parallel flat walls and an interconnecting end wall, said boom being connected to said end wall, said pivoted connector being pivoted between said parallel flat walls opposite said end wall, said main housing being secured to one of said parallel flat walls with said drive shaft extending between said flat walls.

4. A hydraulic pivot device as claimed in claim 1, wherein a pressure inlet conduit communicates with said fluid chamber, said fluid chamber having a port communicating with one of said opposed ends of said piston cylinder, said pilot conduits comprising a pair of intermediate conduits formed in said main housing.

5. A hydraulic pivot device as claimed in claim 1, wherein said lock valve housing is provided with an evacuation port for the removal of air from said fluid chamber, and removable securing means for closing said evacuation port.

6. A hydraulic pivot device as claimed in claim 1, wherein said piston is an elongated piston rod of circular cross-section and having opposed piston heads, an intermediate portion of said piston rod between said piston heads having a series of gear teeth disposed in a straight plane and constituting said toothed section.

7. A hydraulic pivot device as claimed in claim 6, wherein said drive shaft extends through a hole in a wall of said main housing for sealing engagement with said housing, said hole being partly offset from said piston cylinder so that a section of said pinion gear is in toothed engagement with said series of gear teeth on said piston rod.

8. A hydraulic pivot device as claimed in claim 6, wherein said circumferential sealing means is constituted by an anti-friction ring and seal ring spaced apart about said piston head adjacent opposed ends of said piston rod.

9. A hydraulic pivot device as claimed in claim 1 wherein said piston is provided with adjustment means in opposed ends thereof to adjust the stroke travel of said piston in said cylinder.

10. A hydraulic pivot device as claimed in claim 9 wherein said adjustment means is constituted by one or more discs removably secured in said opposed end of said piston heads, said cylinder having opposed piston head chambers, and a cavity in an end wall of said chambers to accomodate a head of a fastener retaining discs.

* * * * *

UNITED STATES PATENT AND TRADEMARK OFFICE

CERTIFICATE OF CORRECTION

PATENT NO. : 4,768,662

DATED : September 6, 1988

INVENTOR(S) : Bertrand Poudrier, François Thibault, Sylvain Leduc

It is certified that error appears in the above-identified patent and that said Letters Patent is hereby corrected as shown below:

Title page:

In the Abstract, line 15 the words "wall impact"

should read --will impart--

Signed and Sealed this

Twenty-first Day of March, 1989

*Attest:*

DONALD J. QUIGG

*Attesting Officer*

*Commissioner of Patents and Trademarks*